United States Patent [19]

Sauro

[11] Patent Number: 4,716,862

[45] Date of Patent: Jan. 5, 1988

[54] OLEODYNAMIC DISTRIBUTION SYSTEM, WITH SEPARATE CONTROL OF THE SUCTION AND EXHAUST VALVES, WITH CONTINUOUS TIMING SETTING WITH RUNNING ENGINE, FOR ALL FOUR-STROKE CYCLE ENGINES

[76] Inventor: Gastone Sauro, Vicolo delle Ville, 8, 34123 Trieste, Italy

[21] Appl. No.: 780,679

[22] Filed: Sep. 26, 1985

[30] Foreign Application Priority Data

Jan. 23, 1985 [IT] Italy ..... 82801 A/85

[51] Int. Cl.[4] ..... F01L 9/02

[52] U.S. Cl. ..... 123/90.12; 123/90.15

[58] Field of Search ..... 123/90.12, 90.13, 90.15

[56] References Cited

U.S. PATENT DOCUMENTS

| | | | |
|---|---|---|---|
| 1,473,077 | 11/1923 | Bull | 123/90.12 |
| 1,763,154 | 6/1930 | Holzwarth | 123/90.12 |
| 1,807,832 | 6/1931 | Davis | 123/90.13 |
| 2,692,588 | 10/1954 | Cathers | 123/90.13 |
| 3,361,121 | 1/1968 | Schott | 123/90.13 |
| 4,106,446 | 8/1978 | Yamada et al. | 123/90.13 |
| 4,258,672 | 3/1981 | Hietikko | 123/90.12 |

*Primary Examiner*—Ira S. Lazarus

*Attorney, Agent, or Firm*—Browdy and Neimark

[57] ABSTRACT

Oleodynamic distribution system, with separate control of the suction and exhaust valves, with continuous time setting of all running four-stroke-cycle engines. This distribution system uses specific profiled pumping element to generate suction phase and exhaust phase having this specific profile and having reduced the number of moving components it will be simple to adjust the timing of system for all speeds and engines without the need of changing components.

18 Claims, 9 Drawing Figures

OLEODYNAMIC DISTRIBUTION SYSTEM, WITH SEPARATE CONTROL OF THE SUCTION AND EXHAUST VALVES, WITH CONTINUOUS TIMING SETTING WITH RUNNING ENGINE, FOR ALL FOUR-STROKE CYCLE ENGINES

FIELD OF INVENTION

This invention relates to an oleodynamic distribution system, with separate control of the suction and exhaust valves, with continuous time setting of a running engine, for all fourstroke-cycle engines.

BACKGROUND

There have been many different solutions to the problem of the timing in four-stroke-cycle reciprocating engines. One in particular that has been implemented in practice and is widespread is where a number of mushroom type valves, driven by an eccentric, regulate the suction and exhaust phases of the cycle developed by the engine.

Between the eccentric and the valves, there are other mechanical components making up a particular kinematic chain such as: caps, rods, rocking arms, timing devices, rockers, etc.

The eccentric rotates at a speed which is half that of the driven shaft; it is therefore necessary to provide an appropriate system of speed reduction.

Although expanding technology and experience has allowed higher degrees of efficiency and reliability, the results are complex, noisy and inefficient, and subject to wear and breakdowns; they require constant maintenance with considerable high costs of production.

SUMMARY

Compared to the traditional systems, the oleodynamic distribution system of the present invention maintains the suction and exhaust valves, while all the components controlling the valves are completely changed.

The operation of the valves in the traditional system is administered by transmitting the power through the connection between the eccentric and the first component of the kinetic chain. In the present invention the power is transmitted to pressure pulses generated in a special pumping element and transmitted to the valves through simple pressurized ducts. This substantial simplification of manufacturing as well as reduced operating noise, results from a reduction in the number of interacting moving components.

The distribution system of the present invention solves yet another problem dealing with timing, which the traditional systems do not. It is well known that the ideal four-stroke engine cycle includes an opening/closing sequence of the suction and exhaust valves. The suction valve remains open during the suction phase corresponding to the stroke of the piston from the top dead center (TDC) to the bottom dead center (BDC), while the drive shaft revolves 180° and remains closed during all other phases. The exhaust valve remains open during the exhaust phase corresponding to the piston stroke from the BDC to the TDC, and remains closed during all other phases.

In order to improve the engine efficiency taking into account the actual working conditions of the engine (inertia of the working fluid and mechanical components), the timing diagram has to be calibrated to provide:

An opening prior to TDC and a closing after BDC of the suction valve.

An opening prior to the BDC and a closing after the TDC of the exhaust valve.

These opening advances and closing delays of the valves amplify the suction and exhaust phases and are necessary to achieve maximum filling and emptying of the cylinder, and are fundamental to a good engine output. These advances and delays vary according to the type of engine. The advances and delays vary with the operation mode of the engine itself.

In traditional systems of valve control, there is only one possible timing diagram; therefore, the engine only operates in optimum timing conditions under certain circumstances. With the timing systems of the present invention, uncountable combinations of timing diagrams are possible, and the engine can always operate in optimum timing conditions. Moreover, components of the timing system of the present invention can be used on other types of engines. whereas in traditional systems it would be necessary to change at least the camshaft.

The advantages of the present invention are in production, storage, marketing, and spare parts, etc. The oleodynamic distribution system described herein is based on an internal gear pumping element, consisting of a fixed part (casing), a moving section (core) , and two lateral closing covers (transversal).

In some arrangements, the casing is a fixed element, firmly secured to the engine bedplate. In other cases, it is a fixed element with respect to the constant speed of the engine, as considerable angular movements are allowed to the casing in order to set the timing diagram to accomodate the various speeds of the engine. The casing is internally shaped according to a specially designed (transversal) profile (made up of interconnected circle arcs with appropriate radii) on which seven protruding parts and seven notches are evident.

The core, or moving part, is also shaped according to an appropriate profile with six protruding parts and six notches. In general, the protruding parts on the casing match to the notches on the core, while the casing notches match the protruding parts on the core. The core is assembled inside the casing with its longitudinal axis parallel and eccentric to the casing longitudinal axis. The core axis revolves around the casing axis, keeping eccentricity constant, with the revolving speed equal to that of the drive shaft.

The movement, along the core axis, produces a backward rotating movement of the core around its axis, according to the shape and size of the casing and core profiles, whereby the protruding parts of the latter fit into the casing notches. This means that if the core axis rotates clockwise around the casipg axis, the core itself rotates counterclockwise around its own axis giving a specific planetary motion of the core with respect to the casing. This motion is the result of the combination of the core longitudinal axis revolution around the casing and the core rotation around its longitudinal axis. In any case, the motion is such that after two complete rotations of the core axis around the casing, both core and casing assume their original positions similar to four-stroke-cycle engines, where the initial position is assumed after two revolutions of the drive shaft.

During this motion, chambers of various volumes are created between the core and the casing; the boundaries of these chambers being marked by the protruding parts and notches of the two elements, as well as by the two lateral (transversal) covers. Clearly, if a suitable fluid is in these chambers, when they reduce their volume, the resulting pressure can be used to open or close a valve. The fluid referred to could be engine lubricating oil. At any rate, there are no real limitations in this respect and the choice of a suitable fluid can be made on the basis of practical considerations.

Given the particular shapes and dimensions of the core and casing, as well as the precise working and surface finish of the profiles, the chambers are always separated from each other and are pressure fluid-tight. Six chambers are created and since a cylinder has suction and exhaust valves, three cylinders can be controlled. More cylinders can be controlled but the drawback is that two or more cylinders will have to operate with time synchrony, a situation which, generally, is avoided so as to have a more gradual power output of the engine. At any rate, it is best to separate the control of the suction valves from that of the exhaust valves, thus having two casing-core units. In this way, up to six cylinders can be controlled separately.

In order to increase the number of cylinders, the number of casing-core units has to be increased or there has to be cylinders time synchronism.

The criteria on which one of the two solutions is chosen depends solely upon practical requirements. Going into detail, pressure outlets (as many as the valves to be controlled are and up to a maximum of six separate ones) are created where the protruding parts on the casing are; these outlets are then connected, through adequate pressure pipings, to the cylinder-piston units controlling the valves.

On the core, in way of the notches, there are three fluid passages with a radial outline, one for each notch; they coverage towards the core longitudinal axis and discharge the fluid in a plenum vessel. The other three notches are blank.

Fluid intake orifices and pressure orifices are provided on the lateral covers (on only one or both, according to the type of engine); leading to a pressure chamber which draws from a fluid plenum vessel.

During the core motion inside the casing, six pressure chambers, as previously described, are created, each of which is surrounded by a core notch and its adjacent protruding parts, bypassing the casing to a certain degree around the protruding part with the pressure intake.

With this arrangement, three pressure chambers are operating (those surrounded by the blank core notches), while the remaining three, delimited by the core notches on the way of the fluid passages are not operating. This is true because the valves have to open and close in sequence; while some are open, others are closed.

If less than six valves are operating, some chambers have to be inactive. This is easily made possible by eliminating the pressure outlet and replacing it with a direct discharge into the plenum vessel, which can be arranged on one of the covers. However, the pressure outlet could be maintained by connecting the pressure manifold to the plenum vessel, without controlling any valve-driving pistons.

In this case, the valve operates according to the following sequence, which as referenced point has a particular pressure intake on the casing leading to another valve, for example the suction valve.

During this motion, the core uncovers the intake orifice and the fluid enters the active pressure chamber (i.e. delimited by a blank core notch). In the cylinder, to which the valve leads, the exhaust phase of the preceding cycle is completed.

After a certain amount of time, the core covers the intake orifice and, simultaneously or immediately thereafter, uncovers the pressure outlet. The pressure chamber volume is reduced while the fluid pressure is suddenly increased; once a certain pressure is exceeded, the valve opens by means of a driving piston. This triggers off the suction phase within the cylinder before the TDC, as necessary.

During the motion of the core inside the pressure chamber, an almost constant pressure is maintained and the valve remains open and the suction phase continues.

The core reaches a particular position in which the pressure releasing orifice is uncovered. The result is a sudden pressure drop inside the chamber and on the related piston which in turn causes the closing of the valve (i.e. by means of a spring behind the valve). The suction phase inside the cylinder ends after the BDC.

Continuing its motion, the core creates another pressure chamber, this time inactive, since it is delimited by a core notch (where a passage for the fluid discharge is provided). There is no pressure increase inside the chamber and the valve remains closed. Inside the cylinder, the successive phases of compression, expansion, and discharge take place.

After two revolutions of the drive shaft, returning to the initial position, another active pressure chamber is created, by way of the pressure outlet, and the cycle resumes.

This is true for any other pressure outlet leading to suction valves and is repeated similarly for the exhaust valves.

The time in which the valve opens and closes the timing diagram of the engine) depends on the time in which the core covers the intake orifice and uncovers the releasing pressure orifice, respectively.

If the opening and closing of the valves are to be in synchrony with the piston stroke inside the engine cylinder, the above covering and uncovering timings depend on the position of the above-mentioned orifices with respect to the casing, being in a specific position relative to the engine bedplate.

There are various ways of adjusting the timing diagram. Briefly, they are the following:

(1) Fixed and appropriately arranged casing with respect to the engine frame, fluid intake, and pressure releasing orifices which can be positioned angularly with respect to the casing.

If the orifices are on the lateral covers, a number of variations can be provided:

One orifice is on one cover and another one on the other; Both covers can be positioned angularly with respect to each other and/or the casing.

The orifices are on only one of the lateral covers which are split into two concentric circular crowns positioned angularly with respect to each other and/or the casing. One orifice is provided on one crown and another one on the other.

(2) One orifice (either the fluid intake one or the pressure releasing one) is an integral part of the casing which can in turn be positioned angularly with respect to the engine bedplate.

The other orifice can be transferred on the casing. It is possible, by implementing one or the other of these two methods, to continuously adjust, within an extended range, the timing diagram of any type of four-stroke-cycle engine and at any operating speed.

In many situations, it is not necessary to have such a wide and complete adjustment scope. Other setting diagrams entailing simpler manufacturing solutions can be adopted.

BRIEF DESCRIPTION OF DRAWINGS

The description and enclosed drawings refer to one of these setting diagrams and are a useful and schematic example of implementation of of the present invention on a single-cylinder engine; and should be considered as simple examples of the above and not an attempt to reduce the really vast and revolutionary scope of the invention described herein.

DETAILED DESCRIPTION OF THE INVENTION

Figure 1:
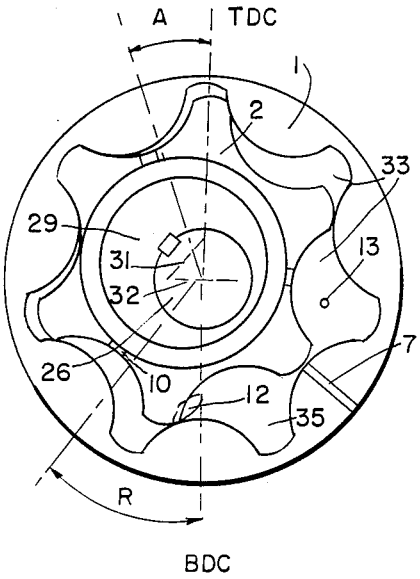
FIG. 1 shows the core-casing arrangement with respect to the engine cylinder axis, during the pressure chamber filling phase.
Figure 2:
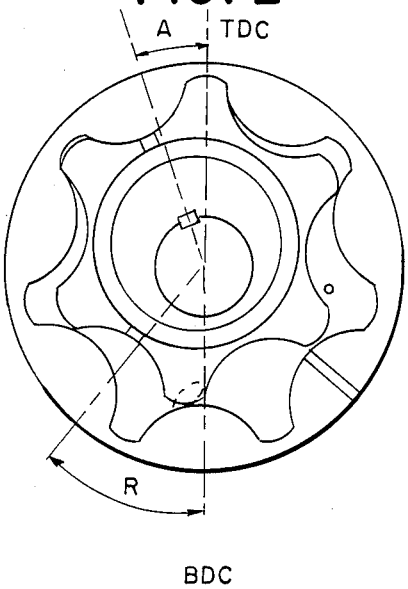
FIG. 2 shows the same arrangement of FIG. 1 but at the moment of the pressurizing of the pressure chamber.
Figure 3:
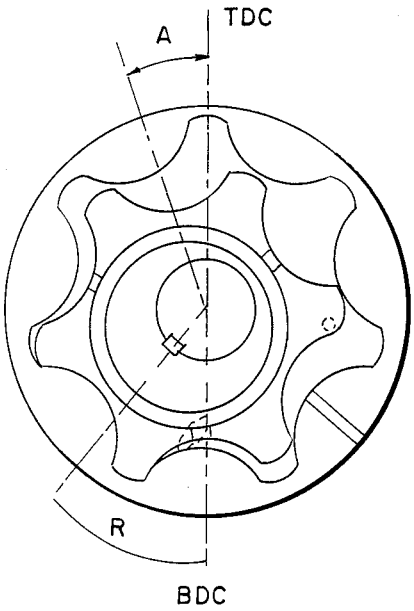
FIG. 3 shows the same arrangement as in FIG. 1 but at the moment in which the pressure releasing orifice is uncovered with the sudden consequent pressure drop.
Figure 4:
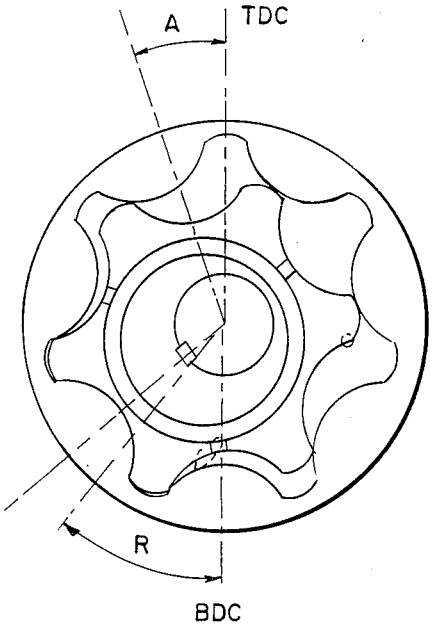
FIG. 4 shows the same arrangement as in FIG. 3 but during the phase in which the valve (to which the pressure chamber leads) is to remain closed.

In detail: The oleodynamic control is made up of casing 1, containing the core 2, laterally closed by a closing cover 3 and a setting cover 4. Casing 1 is internally shaped, all along its longitudinal extent, according to a special profile consisting in seven protruding parts 5 and seven depressions 6. These parts 5,6 can be chaped in the form of arcs of suitable radial circle, adequately faired together. On one of these protruding parts 5 is a pressure outlet 7 which can consist of a hole passing through the protruding parts 5 in the radial direction.

The core 2 is shaped, all along its longitudinal extent, according to another profile made up of six teeth 8 and six notches 9 arranged so that the teeth 8 can engage into the depressions 6 and the notches 9 can receive the protruding parts (or projections) 5. Fluid discharges 10 are provided radially on three of the notches 9, while the other three notches 9 are blank; all of which is designed so as to have, alternately, one notch with discharge and one blank. The closing cover 3 is secured to casing 1 with bolts 11 and makes up an integral part of the casing itself. The setting cover 4 on which are located with fluid intake orifice 12 and the pressure releasing orifice 13, can be rotated around the casing 1.

These four elements (casing 1, core 2, closing cover 3, setting cover 4) make up the pumping element generating the pressure pulses controlling the valve opening and closing. Two of these pumping elements are provided and they control and set the suction phase and the exhaust phase, respectively. The two pumping elements are arranged inside an external envelope 14 which is integral with the engine frame 15. Stoppers 16 prevent axial movements of the pumping elements, while they (or rather, their component parts) can move angularly in relation to the external envelope 14.

In fact, a number of pins 17 are welded on the closing cover 3 and setting cover 4; a fork 18 is inserted on each of these pins; each fork leads to the control rod 19, which crosses the external envelope 14, thus enabling it to be operated from the outside. Angular movements of the pins 17 correspond to translations of the control rod 19, which is coupled to the pins. The setting cover 4 and casing 1 can thus be moved angularly, one independently of the other.

The pressure manifold 20, fitted with the pressure outlet 7, is on the inside of the external envelope. This pressure manifold 20 develops for a certain circle arc such that, in spite of moving the casing 1 angularly, the pressure outlet 7 can still have the manifold as its outlet. The pressure piping 21, leading to the engine valve, starts from the pressure manifold 20.

Inside the external envelope 14 and between the two pumping elements is a fluid plenum vessel 22, with related inspection and fluid-loading plug 23. The external envelope 14 is delimited on one side by the engine frame 15 and closed on the other by the external cover 24 which is fixed to it with screws 25.

The shaft 26 is supported by sleeve bearings 27 and is directly connected to the engine shaft; therefore, it rotates at same speed. The eooenlr:os 29 are keyed unto the shaft 26 by means of keys 28; on each eccentric the core 2 is arranged with an interposed roller case 30.

The core 2 can rotate on its longitudinal axis 31, which coincides with the eccentric 29 axis, and can also rotate around the axis 32 of the shaft 26. The rotation of shaft 26 by conducting the movement of the core 2 creates pressure chambers between matter (fluid) and the casing 1. Of these, five are inactive pressure chambers 33, where the fluid cannot be compressed.

In the example, the inactivity is obtained by creating, on the setting cover 4, a passage 34 for the fluid with a circular cross-sectioned shape, connecting directly the inactive pressure chambers 33 to the fluid plenum vessel 22. What remains is the active pressure chamber 35, leading to the pressure outlet 7.

Figure 5:
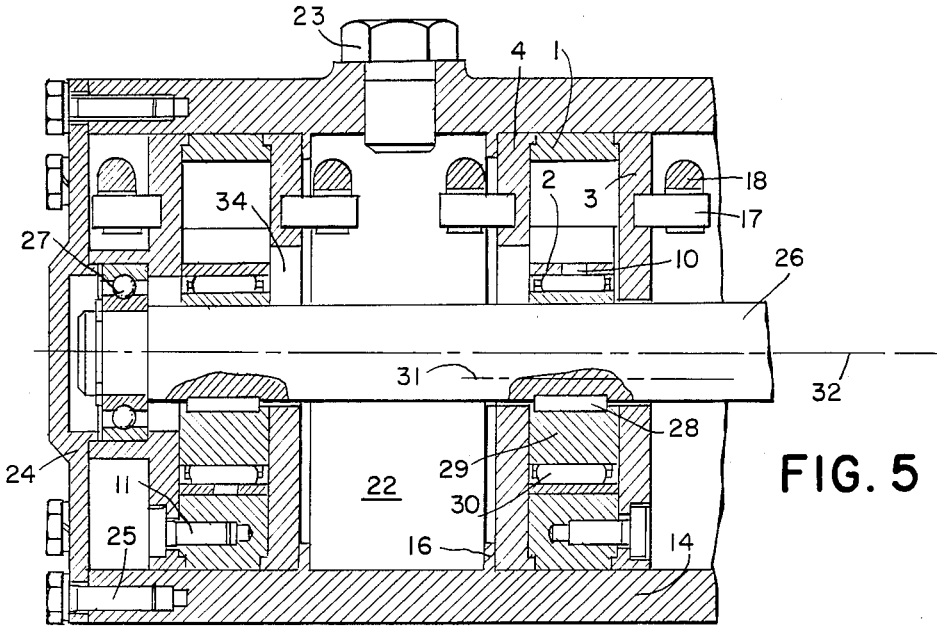
FIG. 5 shows the longitudinal section of the oleodynamic control of the valves.
Figure 6:
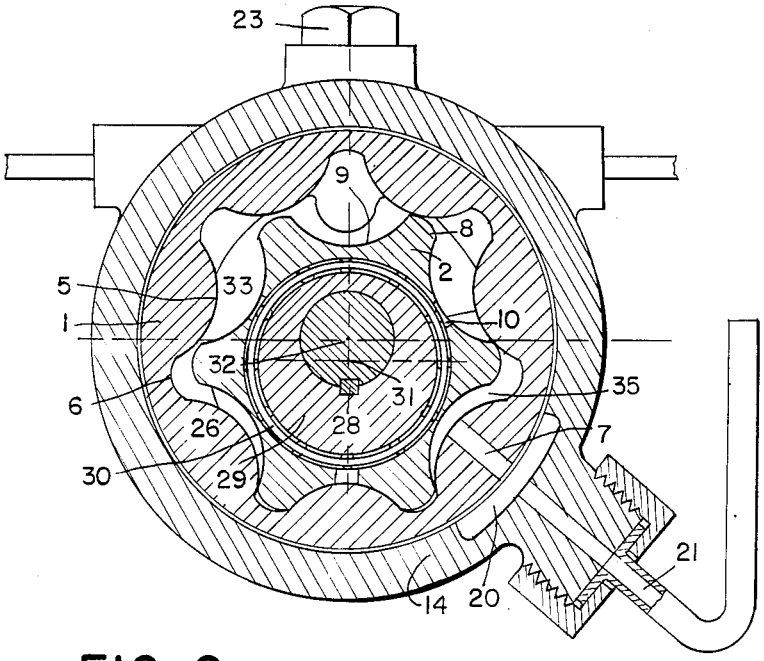
FIG. 6 shows the transversal section of a pumping element.
Figure 7:
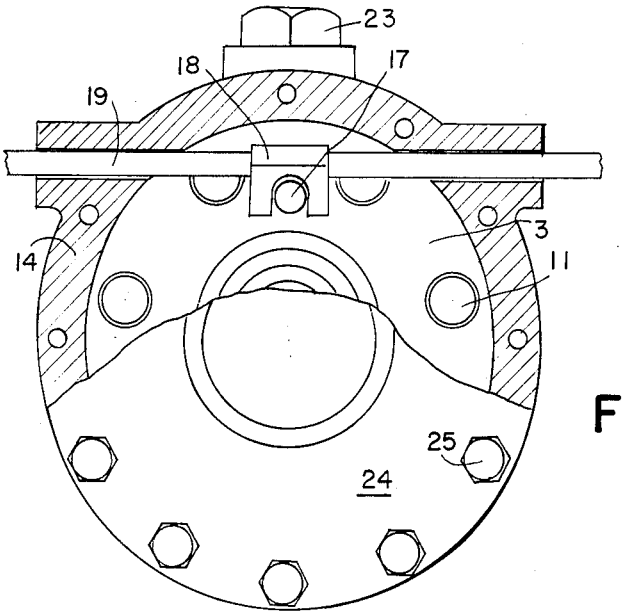
FIG. 7 highlights the angular movement control of the casing.
Figure 8:
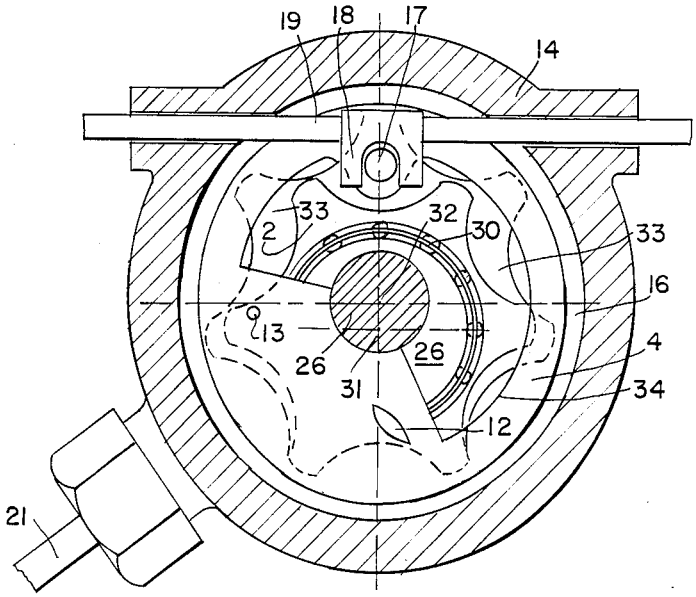
FIG. 8 highlights the angular movement control system of the setting cover.
Figure 9:
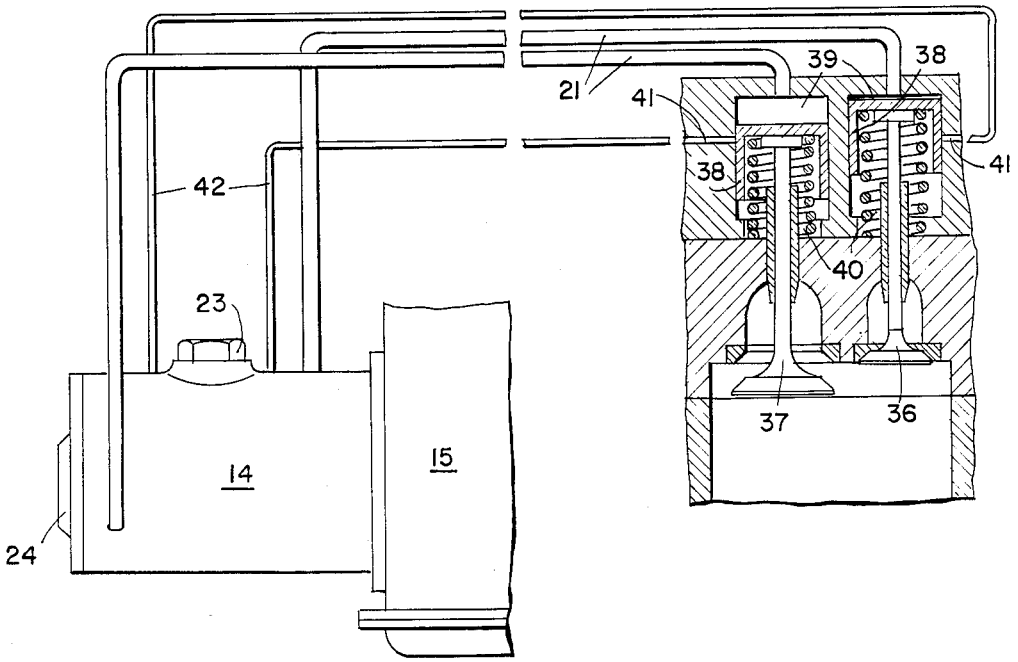
FIG. 9 shows the general arrangement of the oleodynamic control of the valves on the engine bedplate, as well as the connection between the bedplate and the valves.

Referring to FIG. 9 the exhaust valve 36 and the suction valve 37 are both provided with a piston 38 which can translate freely in the cylinder 39. The compressed fluid coming from the pumping element acts on one face of the piston 38; the return spring 40 acts on the other and contrasts the fluid pressure as well as tending to close the valve when said pressure falls below a certain set value. On the cylinder 39 of each valve is a valve lift stopping groove 41, which is connected to the fluid plenum vessel 22 (FIG. 5) by means of a tube 42.

When the piston 38 uncovers this groove 41, the fluid pressure in the cylinider 39 drops, thus interrupting the lift of the valve concerned. In order to have a better understanding of how pressure pulses are generated inside the pumping element, it is useful to follow the sequence of opening and closing phases of the suction valve in FIGS. 1, 2, 3, 4, 5, and 6.

During the various phases of the engine cycle, the piston is moving towards the top dead center (TDC) by the end of the exhaust phase of the previous cycle. While the core 2 is the pumping element is not covering the fluid intake orifice 12 completely, it allows the fluid to enter the active pressure chamber 35, which is delimited by a blank notch 9. During the piston and core 2 movements, the latter covers the fluid intake orifice 12 completely, whereas it uncovers the pressure outlet 7.

The active pressure chamber 35 tends to reduce its volume and the fluid inside it is compressed and goes to act, through the pressure piping 21, on the piston 38 which, in turn, operates the controlled valve concerned, in this case, the suction valve 37. The pressure quickly reaches very high value and overcomes the return spring strength 40, thus opening the suction valve 37. Clearly, by moving angularly the casing 1 in relation to the engine frame, the timing angle of advance suction A is varied with respect to the TDC, thus entailing a first setting of the timing diagram.

Continuing the core 2 movement, the active pressure chamber 35 maintains an almost constant pressure which, in turn, keeps the suction valve 37 open so that there is a suction phase during the piston stroke from the TDC to the BDC and also, partly, during the following return stroke until when the crank angle corresponds to the suction end delay angle R with respect to the BDC. With this arrangement, the core 2 uncovers the pressure releasing orifice 13, the pressure drops suddenly and does not hinder the return spring's action 40 any longer, which closes the suction valve 37.

It is now clear how, by moving angularly the setting cover 4, the position of the pressure releasing orifice 13 varies with respect to the casing 1 and how the suction end delay angle R can vary with respect to the BDC, thus obtaining the adjustment of the timing diagram. (See FIG. 2).

Continuing the rotation of the crankshaft and the movement of the core 2, another active pressure chamber 35 is created in way of the pressure outlet 7; this new pressure chamber 35 tends to reopen the suction valve 37 while this is to remain closed and, in the cylinder, the compression, expansion, and discharge phases take place.

The new active pressure chamber 35, though, is delimited by a notch 9, provided with a discharge 10 which temporarily disactivates the chamber itself. In fact, the fluid in the chamber is not compressed and, passing through the discharge 10 and the roller cage 30, it flows into the plenum vessel 22. The suction valve 37 thus remains closed. (See FIG. 4). This is also true with modifications in the case of the pumping element operating the exhaust valve 36.

FIGS. 1-9 with their drawings are only a schematic example, provided only as a practical demonstration of the finding which can vary in shape, arrangement, and positioning without the notion underlying the present invention.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phrasiology or terminology employed herein is for the purpose of description and not of limitation.

What is claimed is:

1. Oleodynamic distribution system, with separate control of suction and exhaust valves, for continuous time setting of a running four-stroke-cycle engine, characterized in that the opening and closing of the valves are determined and controlled by presure pulses which are periodically generated and maintained by two interengaging pumping elements, in a fluid with appropriate fluid characteristics, said time setting being adjustable for various operating conditions, wherein said pumping means consists of:

a casing (1), having a longitudinal axis and being angularly rotatable about the first axis to set the timing to accommodate the various speeds of the engine, said casing having an internal surface including a plurality of alternating protruding parts (5) and notches (6), a core (2) assembled inside said casing (1) with its longitudinal axis parallel and eccentric to said casing longitudinal axis, said core having an external surface including a plurality of alternating protruding parts (8) and notches (9) so that said core notches (9) can receive said casing protruding parts (5) and said core protruding parts (8) can engage into said casing notches (6), said core movement along its axis producing a backward rotating movement; and a closing cover (3), and a setting cover (4) having a fluid intake orifice (12) and a pressure releasing orifice (13), said closing cover and said setting cover closing said assembled casing (1) and core (2) longitudinally.

2. Oleodynamic distribution system of claim 1, in which said core (2) is carried eccentrically by a main shaft (26) whose axis (32) coincides with said casing longitudinal axis.

3. Oleodynamic distribution system, according to claim 2, in which the main said shaft (26), by rotating on its own said axis (32), determines the movement of said core (2) with respect to said casing (1).

4. Oleodynamic distribution system according to claim 3, in which said main shaft (26) is rotated by a crankshaft at the same speed as said crankshaft, said system further including means for controlling the proportion of rotation speed of said main shaft (26) with respect to the speed of said crankshaft.

5. Oleodynamic distribution system, according to claim 4, in which movement of said core within said casing (1) determines the creation of a number of pressure chambers with variable volume, said chambers being separated from each other and fluid-tight, and controlling the engine timing.

6. Oleodynamic distribution system, according to claim 5, wherein said casing includes a fluid plenum, first means for communicating certain ones of said chambers with said plenum, and second means for communicating one of said chambers with said valves, all of said pressure chambers except said one chamber being rendered inactive by means of said first communicating means connecting said inactive chambers (33) directly to said fluid plenum, and said one pressure chamber compressing said fluid and generating a pressure pulse for transmission to at least one of said valves via said second communicating means.

7. Oleodynamic distribution system, according to claim 6, in which in one of said inactive chambers said suction valves (37) and said exhaust valves (36) lead to the same pumping elements.

8. Oleodynamic distribution system, according to claim 6, in which in one chamber (37) said suction valves (37) and the said exhaust valves (36) lead to different ones of said pumping elements.

9. Oleodynamic distribution system, according to claim 8, in which the realization of a specific time setting depends on the position of: said fluid intake orifice (12) and said pressure releasing orifice (13) and hence said closing cover (3), and said setting cover (4) with respect to said one pressure chamber (35); and with respect to said casing (1), and on the position of said casing (1) with respect to the engine frame.

10. Oleodynamic distribution system, according to claim 9, in which the appropriate movements of the said closing cover (3) and said setting (4) and of the said casing (1) are controlled and adjusted such that the best engine performance at every operating condition is achieved.

11. Oleodynamic distribution system, according to claim 10, in which said fluid compressed in said one pressure chamber (35) acts on a piston (38) which is an integral part of each said suction valve (37) and each said exhaust valve (36), thus determining the operation of the said valves.

12. Oleodynamic distribution system, according to claim 11, in which said compressed fluid acting on said piston (38) opens said exhaust valve (36), since its closing mechanism is determined by one or more return springs (40).

13. Oleodynamic distribution system, according to claim 11, in which the said compressed fluid acts on said piston (38) so as to close said suction valve (37), since its opening mechanism is determined by one or more operating springs.

14. Oleodynamic distribution system, according to claim 13, in which the operation of the said spring is determined by a double-acting piston which is an integral part of the valve and connected with two separate said active pressure chambers (35), so that when the first said chamber compresses the fluid, this acts on one face of the said piston whereas the other face does not compress the fluid; this determines the movement of said valve in one direction; vice versa, when the first said chamber does not compress said fluid, it is other said chamber which does so, and said fluid acts on the opposite face of said piston, thus determining the movement of the said valve in the opposite direction; this produces a desmodromic oleodynamic control of the valves.

15. Oleodynamic distribution system, according to claim 14, in which the movements of said valves are limited by a limiting groove (41) which, when uncovered by said piston (38), makes the pressure drop in the cylinder concerned (39).

16. Oleodynamic distribution system, according to claim 15, in which a hydraulic or mechanical system is provided to prevent said valves from hitting against their seats.

17. In an engine having intake and exhaust valves, a fluid distribution system for comtrolling operation of the intake and exhaust valves while continuously setting the timing of the engine, the distribution system comprising:

means, including pumping means supported for eccentric rotation about a first axis for periodically generating fluid pulses, for controlling the opening and closing of said valves, wherein said pumping means comprises a cylindrical casing having a longitudinal axis coinciding with said first axis and an internal surface configured with alternating projections and notches, and a cylindrical core having an external surface configured to engage with said projections and said notches of said casing to define chambers of varying volume, and said controlling means comprises means for communicating at least one of said chambers with said valves.

18. The distribution system of claim 17, wherein said core external surface includes alternating projections and notches, the number of projections and notches of said casing internal surface being greater than the number of projections and notches of said core.

* * * * *